US007111930B2

(12) United States Patent
Studer et al.

(10) Patent No.: US 7,111,930 B2
(45) Date of Patent: Sep. 26, 2006

(54) FLUID SUPPLY HAVING A FLUID ABSORBING MATERIAL

(75) Inventors: Anthony D. Studer, Albany, OR (US); Kevin D. Almen, Albany, OR (US); David J. Benson, Albany, OR (US); David M. Hagen, Corvallis, OR (US); Cary R. Bybee, Sanford, NC (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 352 days.

(21) Appl. No.: 10/811,127

(22) Filed: Mar. 25, 2004

(65) Prior Publication Data

US 2005/0212878 A1 Sep. 29, 2005

(51) Int. Cl.
*B41J 2/175* (2006.01)

(52) U.S. Cl. ..... 347/86

(58) Field of Classification Search ..... 347/85, 347/86, 87; 264/425; 442/59, 411; 521/20
See application file for complete search history.

(56) References Cited

U.S. PATENT DOCUMENTS 5,489,932 A 2/1996 Ceschin et al.
5,555,007 A 9/1996 Ceschin et al.
5,733,490 A * 3/1998 Phillips et al. ..... 264/130
5,963,238 A 10/1999 Scheffelin et al.
5,966,156 A 10/1999 Scheffelin et al.
5,993,917 A * 11/1999 Pan et al. ..... 427/536
6,162,530 A * 12/2000 Xiao et al. ..... 428/292.1
6,286,950 B1 9/2001 Altendorf et al.
6,322,268 B1 * 11/2001 Kaufmann et al. ..... 401/198
6,409,324 B1 6/2002 Hsu
6,660,175 B1 12/2003 Kawamura et al.
6,676,252 B1 1/2004 Bilotta et al.
6,679,594 B1 1/2004 Sesek et al.
6,692,115 B1 * 2/2004 Sanada et al. ..... 347/85

* cited by examiner

*Primary Examiner*—Anh T. N. Vo

(57) ABSTRACT

A fluid supply including a body and a reversibly fluid absorbing material having a first surface energy and disposed in the body. In addition, the fluid supply has at least one fiber having a fiber surface energy where the fiber is disposed within the fluid absorbing material, and the fiber surface energy is less than the first surface energy of the fluid absorbing material.

51 Claims, 8 Drawing Sheets

FLUID SUPPLY HAVING A FLUID ABSORBING MATERIAL

CROSS-REFERENCE TO RELATED APPLICATION

The present application is related to co-pending patent application Ser. No. 10/808,998 filed on the same day herewith by Joseph W. Stellbrink and Eric A. Ahlvin and entitled "Fluid Supply Media."

BACKGROUND

Description of the Art

Over the past decade, substantial developments have been made in the micro-manipulation of fluids in fields such as electronic printing technology using inkjet printers. As the volume of fluid manipulated or ejected decreases, the susceptibility to air or gas bubbles forming in various portions of the system including the fluid supply may increase. Fluid ejection cartridges and fluid supplies provide good examples of the problems facing the practitioner in preventing the formation of gas bubbles in the supply container, microfluidic channels, and chambers of the fluid ejection cartridge. The fluid supply in inkjet printing systems is just one common example.

Currently there is a wide variety of highly efficient inkjet printing systems in use, which are capable of dispensing ink in a rapid and accurate manner. However, there is a demand by consumers for ever-increasing improvements in speed, image quality and lower cost. In an effort to reduce the cost and size of ink jet printers and to reduce the cost per printed page, printers have been developed having small semi-permanent printheads with replaceable ink reservoirs mounted on the printheads. In a typical ink jet printing system with semi-permanent pens and replaceable ink supplies, the replacement ink supplies are generally provided with seals over the fluid interconnects to prevent ink leakage and evaporation, and contamination of the interconnects during distribution and storage. Generally a pressure regulator is added to the reservoir to deliver the ink to the printhead at the optimum backpressure. Such printing systems strive to maintain the backpressure of the ink within the printhead to within as small a range as possible. Typically changes in back pressure, of which air bubbles are only one variable, may greatly effect print density as well as print and image quality. In addition, even when not in use the volume of air entrapped in a fluid supply may increase when subjected to stress such as dropping. Subsequent altitude excursions typically cause this air to expand and displace ink ultimately leading to the displaced ink being expelled from the supply container. The expelled ink will cause damage to the product package or other container in which it is located.

In addition, improvements in image quality have led to an increase in the complexity of ink formulations that increases the sensitivity of the ink to the ink supply and print cartridge materials that come in contact with the ink. Typically, these improvements in image quality have led to an increase in the organic content of inkjet inks that results in a more corrosive environment experienced by the materials utilized, thus, raising material compatibility issues.

In order to reduce both weight and cost many of the materials currently utilized are made from polymers such as plastics and elastomers. Many of these plastic materials, typically, utilize various additives, such as stabilizers, plasticizers, tackifiers, polymerization catalysts, and curing agents. These low molecular weight additives are generally added to improve various processes involved in the manufacture of the polymer, and to reduce cost without severely impacting the material properties. Since these additives, typically, are low in molecular weight compared to the molecular weight of the polymer, they can be leached out of the polymer by the ink, react with ink components, or both, more easily than the polymer itself. In either case, the reaction between these low molecular weight additives and ink components can also lead to the formation of precipitates or gelatinous materials, which can further result in degraded print or image quality.

If these problems persist, the continued growth and advancements in inkjet printing and other micro-fluidic devices, seen over the past decade, will be reduced. Current ink supply technology continually struggles with maximizing the amount of ink delivered while continuing to meet shipping stress and altitude specifications. Consumer demand for cheaper, smaller, more reliable, higher performance devices constantly puts pressure on improving and developing cheaper, and more reliable manufacturing materials and processes. The ability to optimize fluid ejection systems, will open up a wide variety of applications that are currently either impractical or are not cost effective.

DESCRIPTION OF THE PREFERRED EMBODIMENTS

Figure 1:
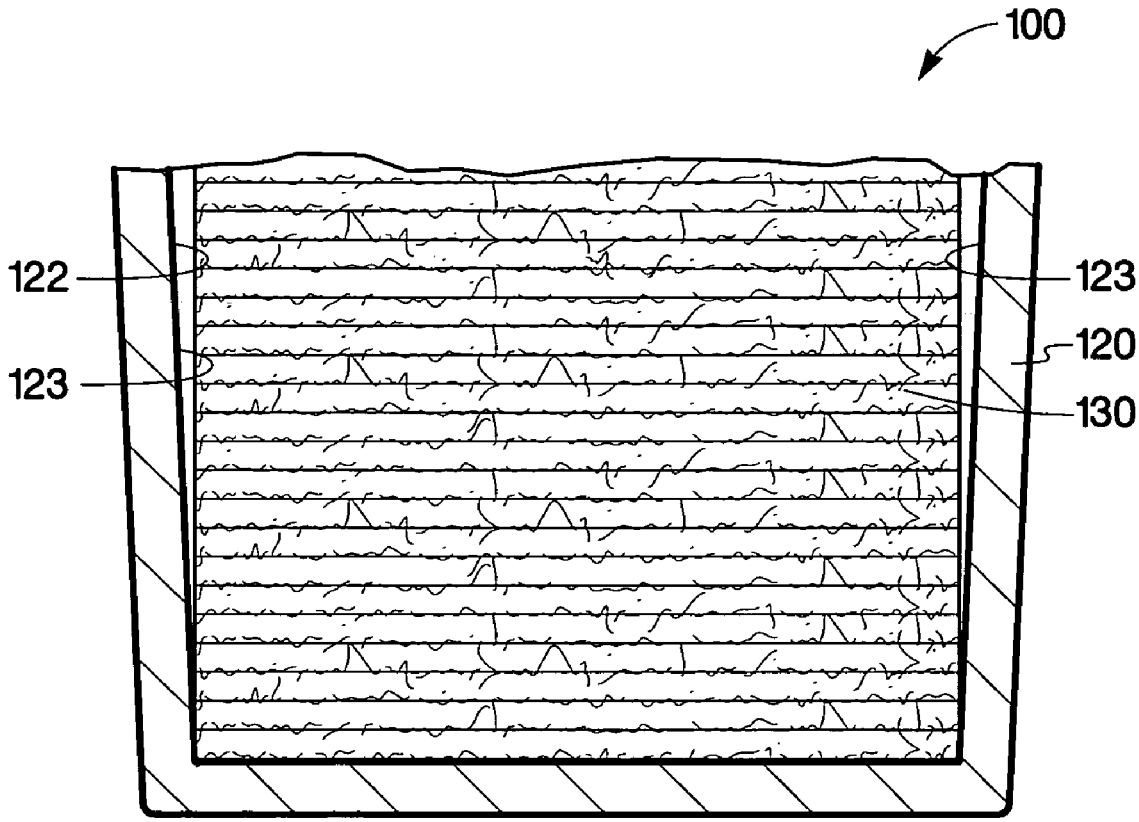
FIG. 1 is a cross-sectional view of a portion of a fluid supply according to an embodiment of the present invention.

A cross-sectional view of an embodiment of fluid supply 100 employing the present invention is illustrated in FIG. 1. In this embodiment, fluid supply 100 includes container or body 120 configured to contain a liquid. Body 120 has sloping interior wall 122 that provides for easy insertion of a reversibly fluid absorbing material such as capillary material 130. In alternate embodiments, body 120 may have a straight or vertical sidewall or any other configuration suitable for enclosing fluid absorbing material 130 and for containing a liquid. In addition, although body 120 is depicted as having a rectangular shape, body 120 may have an interior in any of a variety of different shapes and configurations. After capillary material 130 is inserted into container 120 a fluid may be added to fill fluid supply 100 with capillary material absorbing or wicking the fluid into the capillary material. In this embodiment, container or body 120 is formed by injection molding utilizing polypropylene; however, in alternate embodiments, any suitable metal, glass, ceramic, or polymeric material that is compatible with the fluid being stored also may be utilized. For example, polyethylene, polyester, various liquid crystal polymers, glass, stainless steel, and aluminum are just a few materials that also may be utilized to form body 120. In this embodiment, reversibly fluid absorbing material 130 is a capillary material generally referred to as bonded polyester fiber (BPF). BPF is composed of multiple fiber strands bonded together where each fiber is randomly oriented; however, the BPF block has a "grain", or preferred capillary direction. In alternate embodiments, other materials such as bonded polypropylene or polyethylene fibers, nylon fibers, rayon fibers, polyurethane foam or melamine aslo may be utilized to form reversibly fluid absorbing material 130. Capillary material 130 may utilize fibers formed having a single component polymeric material, blends of materials, as well as multi-component structures such as a bi-component fiber having a polymer core with a coaxial polymer sheath formed from a different material. For example, capillary material 130 may utilize fibers having a polyolefin core such as polypropylene with coaxial polyester sheath. Any material having a surface energy higher than the liquid being stored may be utilized including surface modified materials. In this embodiment, fluid supply 100 also includes at least one fiber (not shown) disposed within capillary material 130 that has a fiber surface energy less than the surface energy of the reversibly fluid absorbing material.

Capillary material 130 is contained within body 120 and is configured to facilitate reliable flow of fluid from fluid supply 100 through an opening (not shown) in body 120 to a fluid ejection system (not shown). In addition, capillary material 130 creates capillary forces that regulate the back-pressure of fluid supply 100. In this embodiment, the fibers are oriented lengthwise in body 120, as represented by the horizontal lines in FIG. 1, so that an "end grain" of the material is adjacent to interior end walls 123 with a fluidic interconnect (not shown) configured perpendicular to the orientation of the fibers of capillary material 130. In locating the fluidic interconnect perpendicular to the fiber orientation of the capillary material a reliable transfer of fluid is obtained by providing for compression during attachment and subsequent recovery during removal of fluid supply 100 for those applications where it is desirable to remove and subsequently reattach the fluid supply for continued operation. In still other embodiments, where reattachment and continued operation is not applicable the fiber orientation of capillary material 130 may be parallel to the direction of fluid flow or to a fluidic interconnect attached to fluid supply 100. For example, in felt tip pens utilizing a fluid supply of the present invention the wick or tip connection may be parallel to the fiber orientation of capillary material 130 because the fluid supply is substantially permanently attached to the pen tip. In such an embodiment, the fluid may comprise a liquid material such as an ink that creates an image or mark upon a printing medium such as a sheet or roll of a cellulose based or polymeric based material when the pen tip is in contact with the printing medium.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views, with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further, it is not intended that the embodiments of the present invention be limited to the physical structures illustrated. These structures are included to demonstrate the utility and application of the present invention in presently preferred embodiments.

Figure 2A:
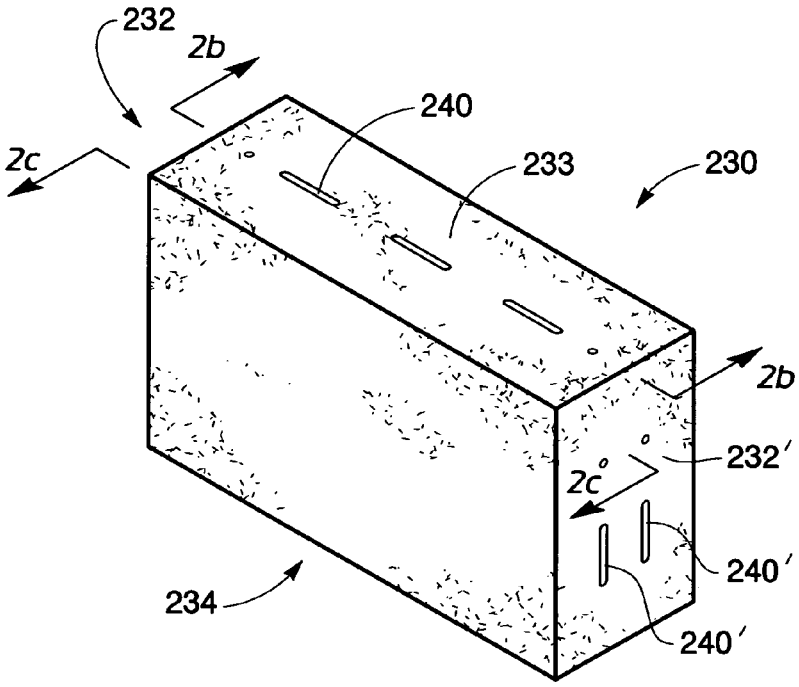
FIG. 2*a* is a perspective view of a reversibly fluid absorbing material according to an embodiment of the present invention.

FIG. 2*a* is a perspective view illustrating an embodiment of a reversibly fluid absorbing material employing the present invention. In this embodiment capillary material 230 includes thread fibers 240 and 240' sewn or woven within the body of capillary material 230. Thread fibers 240 and 240' each have a surface energy less than the surface energy of capillary material 230. Capillary material 230, in this embodiment, is a BPF material formed from individual fibers with an essentially uniform diameter of about 14 micrometers providing a mass for capillary material 230 with an overall density of about 0.13 grams per cubic centimeter. However, in alternate embodiments, a fiber diameter in the range from about 5 micrometers to about 50 micrometers also may be utilized to form capillary material 230. In one particular embodiment, the BPF material includes fibers each having an individual diameter of about 20 micrometers plus or minus 2 micrometers with an overall density of about 0.15 grams per cubic centimeter. In still other embodiments, a mixture of fibers having a range of diameters from about 5 micrometers to about 50 micrometers may be utilized to form capillary material 230. However, in alternate embodiments, capillary material may be formed utilizing other materials as described above and may have larger or smaller diameters as well as a higher or lower density. The particular material, diameter, and density utilized will depend on various factors such as the particular fluid being stored, the amount of the fluid contained in the supply, the particular environmental conditions the supply will be stored and used in, and the expected lifetime of the supply.

Figure 2B:
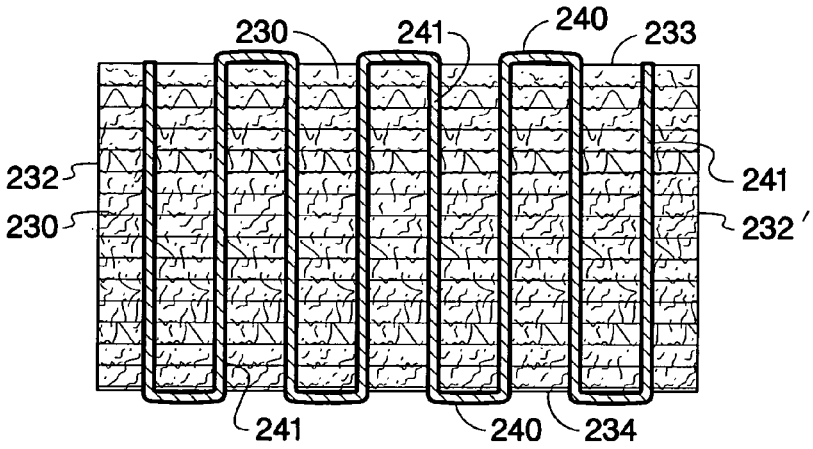
FIG. 2*b* is a cross-sectional view along 2*b*—2*b* showing the fluid absorbing material shown in FIG. 2*a*.
Figure 2C:
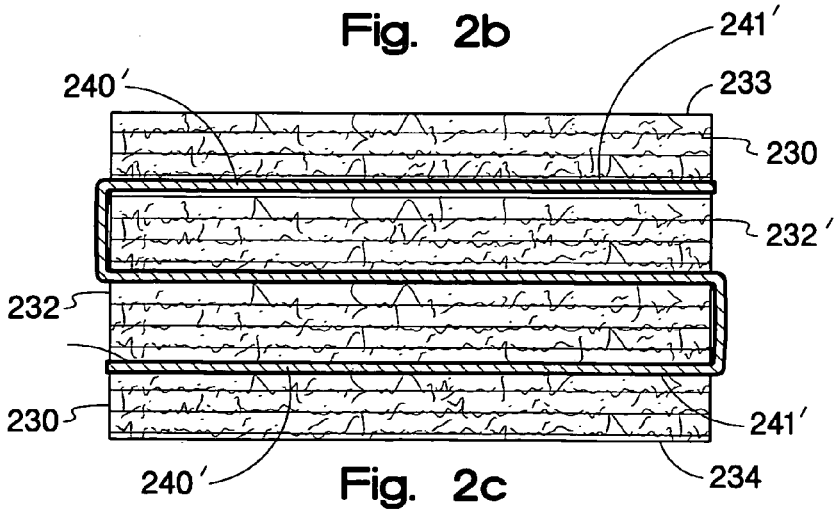
FIG. 2*c* is a cross-sectional view along 2*c*—2*c* showing the fluid absorbing material shown in FIG. 2*a*.

As illustrated in FIGS. 2*b* and 2*c* in cross sectional views, the fluid supply may include larger diameter thread fibers 240 and 240' sewn or threaded into the capillary material. In this embodiment, thread fibers 240 and 240' are each formed from polytetrafluoroethylene having a diameter of 0.5 millimeters. In alternate embodiments, thread fibers 240 and 240' each may have a diameter in the range of from about 5 micrometers to about 1.0 millimeter. An Example of a commercially available polytetrafluoroethylene (PTFE)material that may be utilized in the present invention is available from E. I. DuPont de Nemours & Co. under the trademark "TEFLON." However, in alternate embodiments, many other fluoropolymer fibers formed from materials such as fluorinated ethylene propylene copolymers (FEP), perfluoroalkoxy polymers (PFA), ethylene and tetrafluoroethylene copolymers (ETFE), and polyvinyl fluoride also may be utilized. In addition, other low surface energy materials such as polyethylene, polypropylene, silicones, and natural rubber also may be utilized. The particular fiber material will depend on the particular material utilized to form capillary material 230. Generally, the surface energy of thread fibers 240 and 240' will be about 15 to about 20 millijoules per meter squared lower than the surface energy of capillary material 230. The particular value utilized will depend on various factors such as the particular fluid being stored, the amount of fluid contained within the fluid supply, and the allowable amount of fluid that remains within the container when fully utilized.

In this embodiment, thread fiber 240 forms a single row formed in a serpentine or folded pattern with eight straight portions 241 of fiber 240 equally spaced and extending from top face 233 to bottom face 234 of capillary material 230. In addition, thread fiber 240' forms two rows one row on each side of the serpentine structure formed by thread fiber 240. Further, each row of thread fiber 240' also forms a serpentine pattern with three straight portions 241' extending from one end surface 232 to the other end surface 232' as illustrated in FIG. 2*c*. This configuration provides a weight percent of fiber to capillary material of about 3.8 percent. In this embodiment, straight portions 241 and 241' are substantially parallel to each other and straight portions 241 are mutually orthogonal to straight portions 241'. However, in alternate embodiments, the straight portions may be formed with any of a wide variety of configurations including various angles to each other such as a repeating v shape, as well as various angles to the other fiber, various spacings may also be utilized and each fiber may have various numbers of rows or columns. In addition, thread fibers 240 and 240' also may include fibers having a high surface energy material as a core material with a low surface energy coating forming a low surface energy outer surface. Such fibers may be formed utilizing a wide variety of technologies such as plasma, corona, or flame surface treatments, surface wet chemical treatments, surface coating technologies and co-extrusion technologies.

It is believed that the lower surface energy fiber or thread compared to the surface energy of the capillary material provides a path for entrapped air or gas to travel more easily in the case of thread fiber 240 from bottom face 234 to top face 233 and in the case of thread fiber 240' air or gas may travel more easily to either end surface 232 or 232'. It has been empirically determined that by utilizing a lower surface energy thread sewn into the capillary material a 40 to 50 percent increase in the altitude survival rate after stress is achievable. This provides for an increase in the amount of fluid that may be contained within the fluid supply while keeping the volume of the supply constant.

Figure 3A:
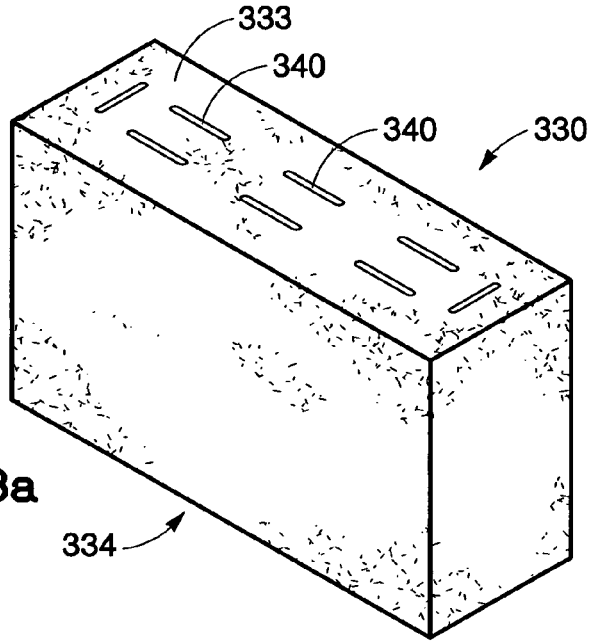
FIG. 3*a* is a perspective view of a fluid absorbing material according to an alternate embodiment of the present invention.
Figure 3B:
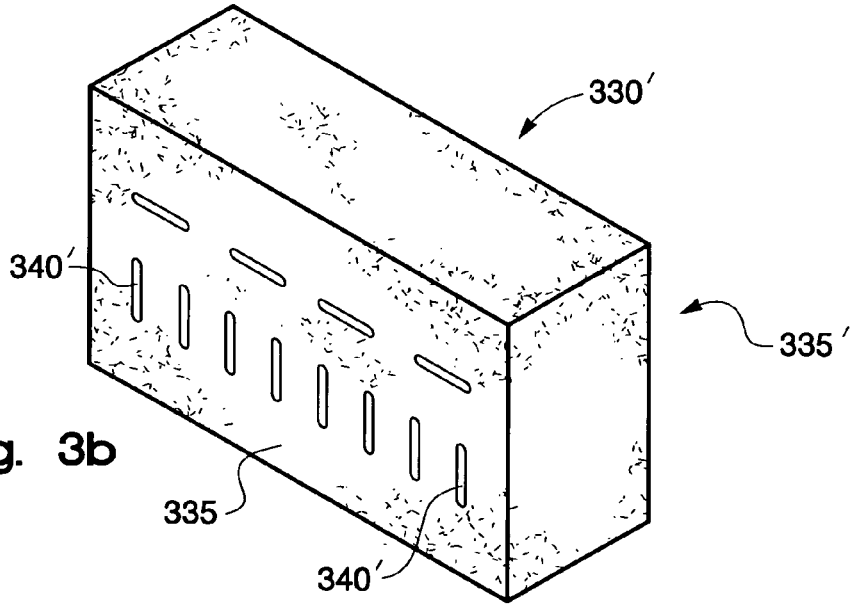
FIG. 3*b* is a perspective view of a fluid absorbing material according to an alternate embodiment of the present invention.

FIGS. 3*a* and 3*b* are perspective views showing alternate embodiments of a capillary material employing the present invention. In the embodiment shown in FIG. 3*a*, thread fiber 340 forms two rows formed of a serpentine pattern with eight straight portions in each row equally spaced and extending from top face 333 to bottom face 334 of capillary material 330. This configuration provides a weight percent of fiber to capillary material of about 2.5 percent. As described above for the embodiment shown in FIG. 2 any of a wide variety of other configurations also may be utilized, in this embodiment. In FIG. 3*b* thread fiber 340' forms three rows formed in a serpentine pattern with eight straight portions in each row equally spaced and extending from one side face 335 to the other side face 335' of capillary material 330'. This configuration provides a weight percent of fiber to capillary material of about 2.5 percent. Thread fibers 340 and 340' each may have a diameter in the range of from about 5 micrometers to about 1.0 millimeter. In addition, thread fibers 340 and 340' each have a surface energy less than the surface energy of capillary material 330'.

Figure 3C:
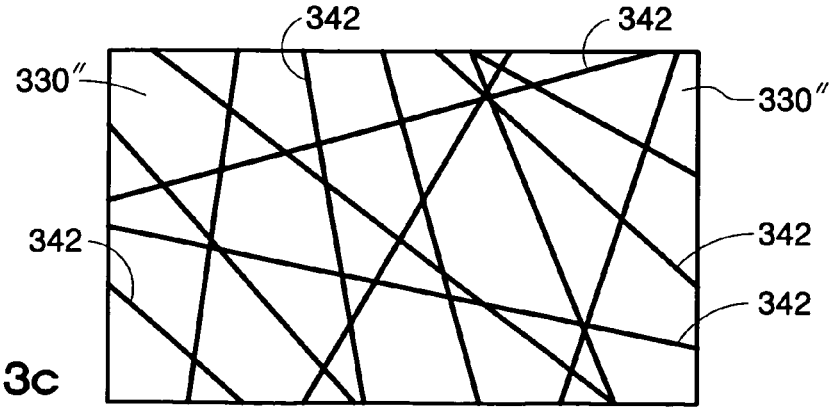
FIG. 3*c* is a schematic elevational view of a fluid absorbing material according to an alternate embodiment of the present invention.

An alternate embodiment of a capillary material that may be utilized in the present invention is shown in FIG. 3*c*, in a schematic elevational view. In this embodiment, long fibers 342 are randomly dispersed within capillary material 330" generally extending from one face to another of the capillary material structure. Long fibers 342 have a surface energy less than the surface energy of capillary material 330". In this embodiment, long fibers (i.e. lower surface energy fibers) 342 have the same or similar diameter as thread fibers 340 and 340' shown in FIGS. 3*a*–3*b*. However, in alternate embodiments, long fibers 342 may have a diameter in the range from about 5 micrometers to about 1.0 millimeter. In still other embodiments, various combinations of fiber diameters as well as fibers having varying diameters also may be utilized.

Figure 4A:
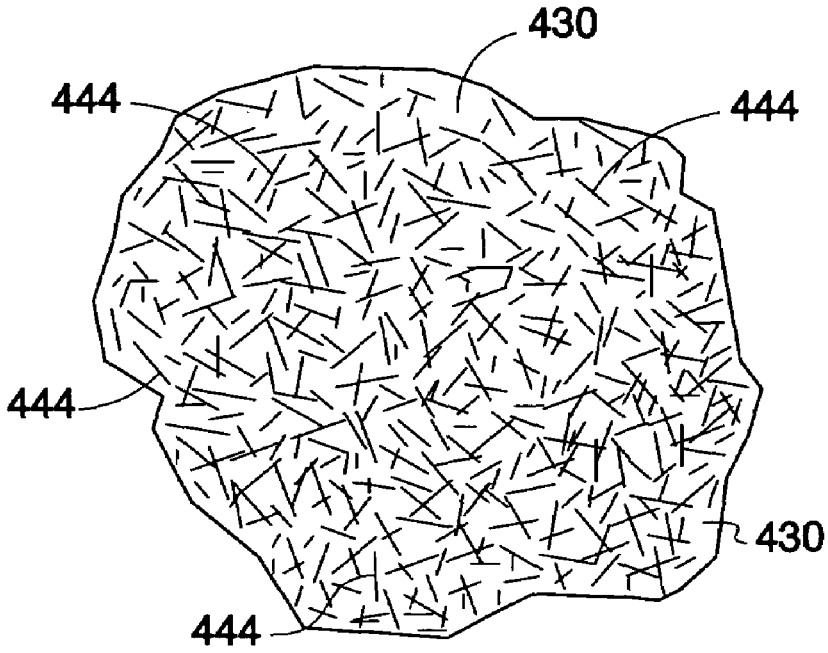
FIG. 4*a* is a cross-sectional view of a portion of a fluid absorbing material according to an alternate embodiment of the present invention.
Figure 4B:
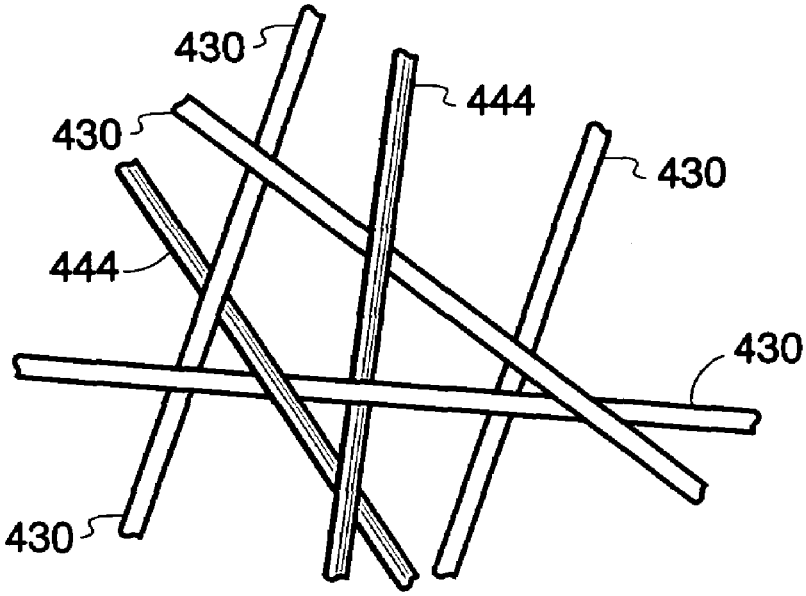
FIG. 4*b* is an expanded view of the fluid absorbing material shown in FIG. 4*a*.

An alternate embodiment of the present invention where the capillary material includes short lengths of lower surface energy fibers randomly dispersed within the fibers forming the capillary material is shown in simplified schematic diagrams in FIGS. 4*a* and 4*b*. Short length fibers 444 generally have a diameter similar to the diameter of the fibers forming capillary material 430. Short length fibers 444 have a length less than the shortest dimension of the body into which capillary material 430 is inserted. In this embodiment, the fibers forming capillary material 430 have a diameter of about 15 micrometers plus or minus 3 micrometers and short length fibers 444 have a diameter in the range of from about 2 micrometers to about 15 micrometers. However, in alternate embodiments, the capillary material fiber diameter may range from about 2 micrometers to about 30 micrometers and short length fibers 444 may range from about 2 micrometers to about 50 micrometers. Short length fibers 444 are mixed in with the capillary fibers during the manufacturing process utilized to form the capillary material 430. In this embodiment, short fibers 444 are added to the capillary fibers to provide a weight percent of fiber to capillary material in the range from about 2 percent to about 5 percent. However, in alternate embodiments other ranges also may be utilized and is generally a balance between the desired amount of fluid to be extracted and the desired overall backpressure range provided by the capillary material. In this embodiment, any low surface energy fiber may be utilized such as polytetrafluoroethylene, fluorinated ethylene propylene copolymers (FEP), perfluoroalkoxy polymers (PFA), ethylene and tetrafluoroethylene copolymers (ETFE), and polyvinyl fluoride, polyethylene, polypropylene, silicones, natural rubber and mixtures thereof.

Figure 5:
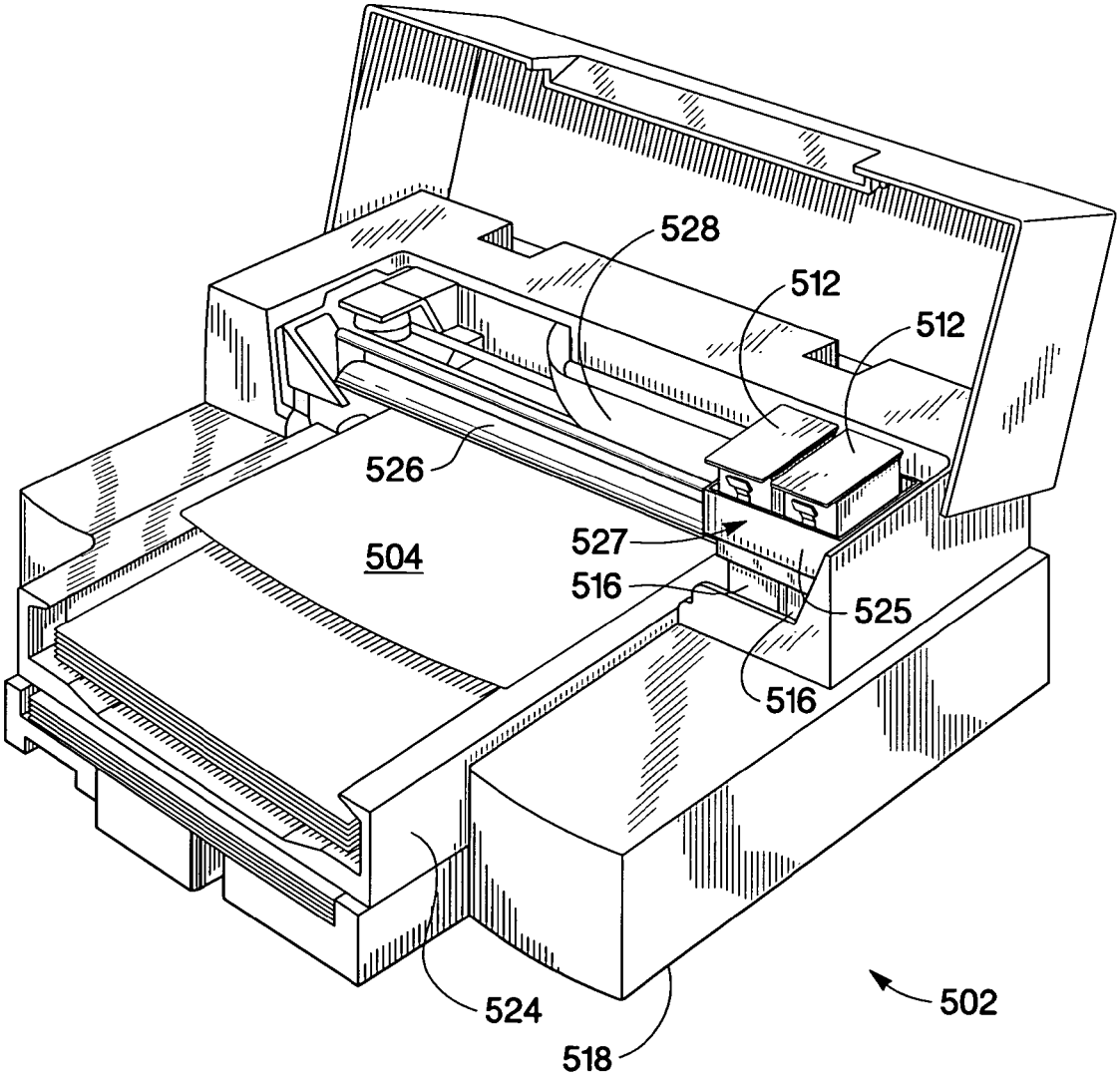
FIG. 5 is a perspective view of an exemplary ink jet printing system in which ink supplies of the present invention may be incorporated according to an embodiment of the present invention.

FIG. 5 is a perspective view of a typical ink jet printing system 502 shown with its cover open. The printing system includes a plurality of replaceable ink containers 512 that are installed in receiving station 525. Ink is provided from replaceable ink containers 512 through a manifold (not visible in this view) to inkjet printheads 516. Inkjet printheads 516 are responsive to activation signals from printer portion 518 to deposit ink on print medium 504. As ink is ejected from printheads 516, the printheads are replenished with ink from ink containers 512. Ink containers 512, receiving station 525, and inkjet printheads 516 are each part of scanning carriage 527 that is moved relative to print medium 504 to accomplish printing. Printer portion 518 includes media tray 524 for receiving print medium 504. As print medium 504 is stepped through a print zone, scanning carriage 527 moves printheads 516 relative to print medium 504. Printer portion 518 selectively activates printheads 516 to deposit ink on print medium 504 to thereby print on medium 504.

Scanning carriage 527 is moved through the print zone on a scanning mechanism which includes slide rod 526 on which scanning carriage 527 slides as scanning carriage 527 moves through a scan axis. A positioning means (not shown) is used for precisely positioning scanning carriage 527. In addition, a paper advance mechanism (not shown) is used to step print medium 504 through the print zone as scanning carriage 527 is moved along the scan axis. Electrical signals are provided to the scanning carriage for selectively activating the printheads by means of an electrical link such as ribbon cable 528.

Figure 6:
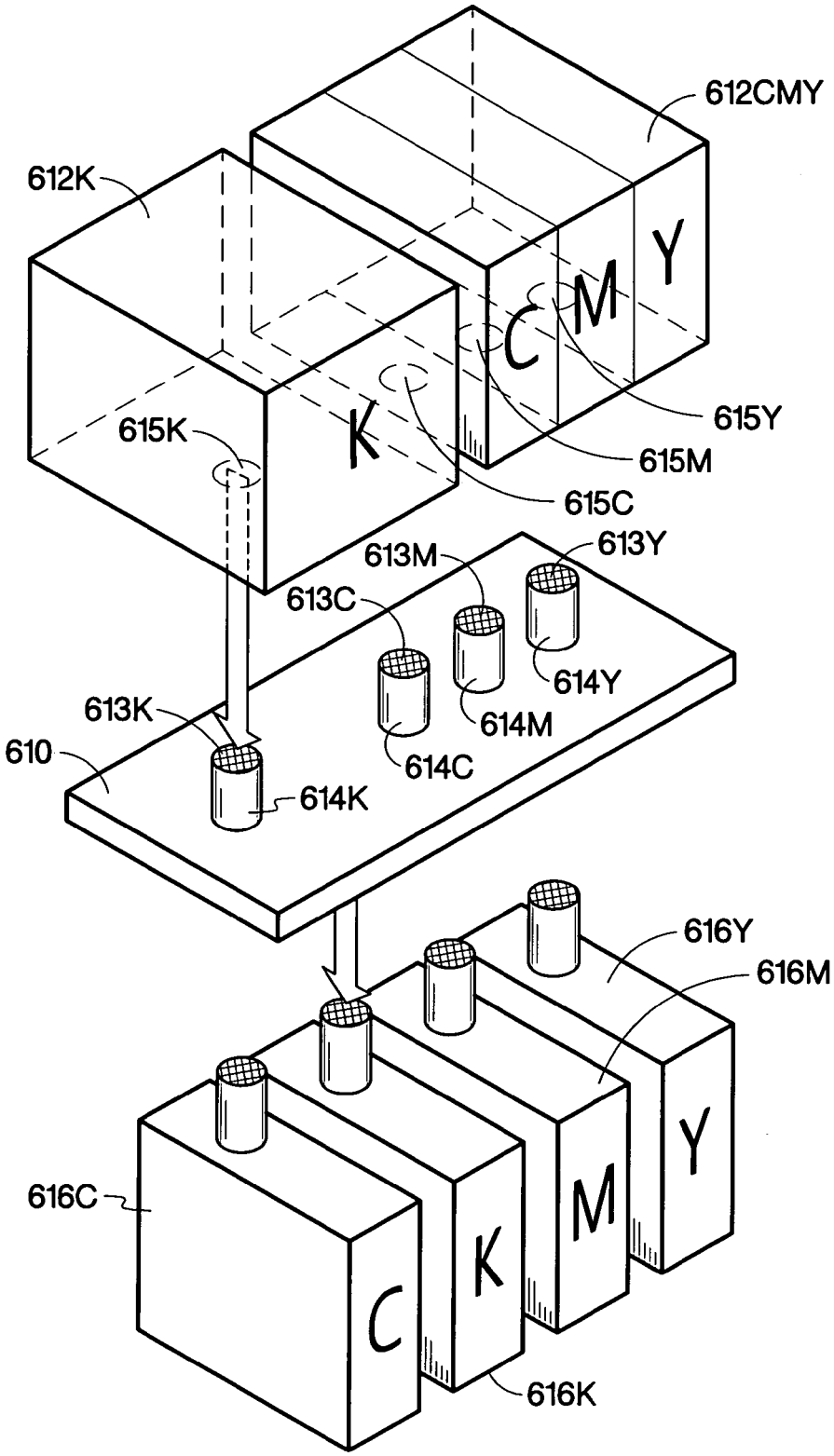
FIG. 6 is a simplified schematic representation of ink supplies, coupling manifold, and inkjet printheads of an exemplary ink jet printing system according to an embodiment of the present invention.

FIG. 6 is a simplified diagram further illustrating the scanning portion of an exemplary ink delivery system (for clarity, the supporting structure of scanning carriage 527 shown in FIG. 5 is omitted). In the exemplary printing system, a pair of replaceable ink containers 612, typically one for black ink and one for color ink, are installed in receiving station 525 (see FIG. 5). The ink containers are substantially filled with a capillary material, as discussed above, which serves to retain the ink. Attached to the base of the receiving station is manifold 610. Inkjet printheads 516, as shown in FIG. 5, are in fluid communication with receiving station 525 through the manifold. In the embodiment illustrated in FIG. 6, the inkjet printing system includes tri-color ink container 612CMY containing three separate ink colors (cyan, magenta, and yellow) and second ink container 612K containing black ink. Replaceable ink containers 612CMY, and 612K may be partitioned differently to contain fewer than three ink colors or more than three ink colors if more are required. For example, in the case of high fidelity printing, frequently six or more colors may be used.

The specific configuration of ink reservoirs and printheads illustrated in FIG. 6 is one of many possible configurations. Towers 614K, 614C, 614M, and 614Y, on manifold 610 engage fluid interconnect ports 615K, 615C, 615M, and 615Y of the replaceable ink supplies. The towers include fine mesh filters 613K, 613C, 613M, 613Y at their apexes which contact the capillary material within the ink containers (not shown in FIG. 6) to establish a reliable fluid interconnect. Internal channels within the manifold (not shown) route the various ink colors to the appropriate printheads 616K, 616C, 166M, and 616Y (for illustrative purposes the path followed by the black ink is illustrated with a broad arrow).

Figure 7A:
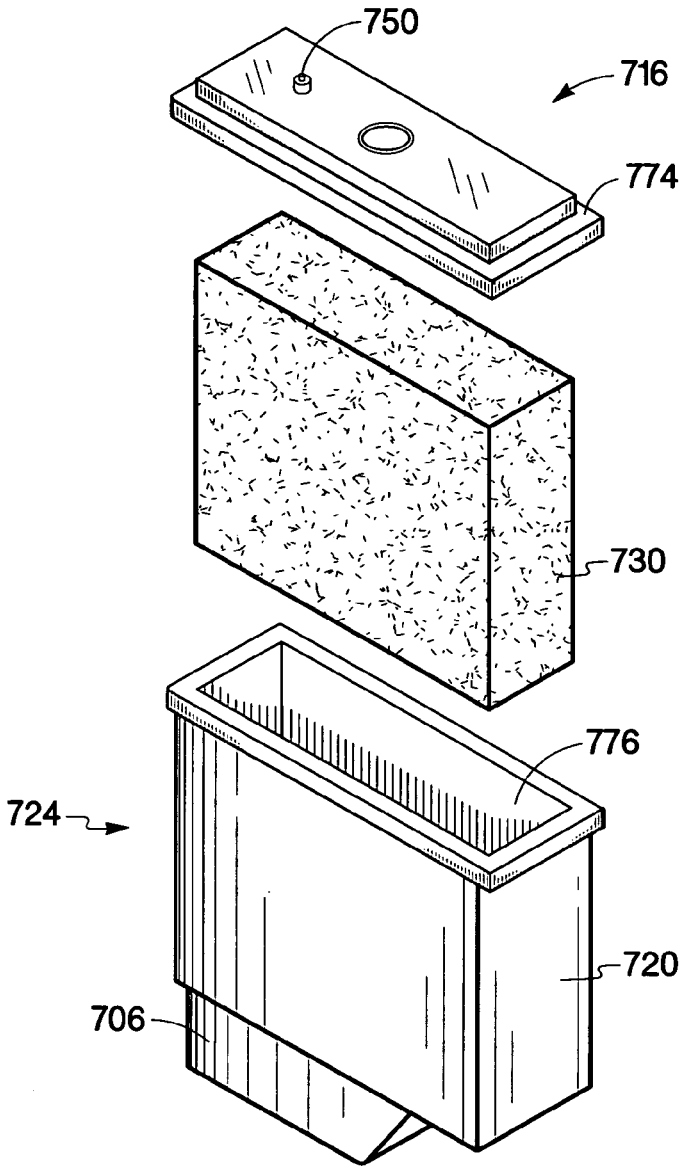
FIG. 7*a* is an exploded perspective view of an ink jet cartridge according to an alternate embodiment of the present invention.

FIG. 7*a* illustrates, in an exploded perspective view, an alternate embodiment of the present invention where ink jet print cartridge 716 includes capillary material 730 disposed within fluid reservoir 724. Print cartridge 716 is configured to be used by a fluid deposition system such as ink jet printing system 502 shown in FIG. 5 or fluid dispensing system 802 shown in FIG. 8. Print cartridge 716 includes fluid ejector head 706 in fluid communication with fluid reservoir 724. Fluid reservoir 724 supplies fluid, such as ink, to fluid ejector head 706 and includes cartridge body 720, reversibly fluid absorbing material 730, and cartridge crown 774 that forms a cap to cartridge body 720. Cartridge body 720 generally comprises a reservoir having interior volume 776 configured to contain reversibly fluid absorbing material 730 that includes one or more fibers (not shown) disposed within capillary material 730 that has a fiber surface energy less than the surface energy of the reversibly fluid absorbing material, where the reservoir and fluid absorbing material 730 contain a fluid to be dispensed by fluid ejector head 706. In this embodiment, fluid absorbing material 730 may include any of the embodiments described above for the reversibly fluid absorbing material having a threaded fiber, or long fiber, or short length fibers, or a combination thereof. The particular embodiment utilized will depend on various factors such as the particular fluid being dispensed, the particular environmental conditions the print cartridge will be stored and used in, and the expected lifetime of the cartridge. In the particular embodiment shown in FIG. 7*a*, print cartridge 716 is configured to be removably coupled to a carriage (see e.g. scanning carriage 527 shown in FIG. 5) and to be conveyed by the carriage along a scan axis across a print medium. However, in alternate embodiments, print cartridge 716 may be configured to be either permanently or semi-permanently coupled to a carriage or some other portion of the fluid dispensing system.

Cartridge crown 774 includes a cover or cap configured to cooperate with cartridge body 720 to enclose interior volume 776 and fluid absorbing material 730 disposed within interior volume 776. In this embodiment, crown 774 is configured to form a fluidic seal with cartridge body 720; however, in alternate embodiments, other capping and sealing arrangements also may be utilized. Crown 774 also includes fill port 750. Fill port 750 generally comprises an inlet through crown 774, enabling print cartridge 716 to be filled or refilled with fluid. In the particular embodiment illustrated, fill port 750 includes a mechanism configured to seal the opening provided by fill port 750 once filling of the print cartridge is completed. In an alternate embodiment, the sealing mechanism may automatically seal any opening formed during the filling process, such as a valving mechanism or a septum. In still another embodiment, fill port 750 may be configured to be manually closed when not in use. Although in the embodiment illustrated in the exploded view shown in FIG. 7*a* the fluid absorbing material 730 is separate from crown 774, in alternate embodiments, fluid absorbing material 730 may be affixed to crown 774 to form a single unit, or the absorbing material may be affixed to interior volume 776 of cartridge body 720. In still other embodiments, fluid absorbing material 730 may be encapsulated or surrounded by a fluid impervious film along its outer surfaces. In such an embodiment, cartridge body is configured to puncture, pierce, or in some other manner provide, such as a valving mechanism, a selective fluid communication between the fluid contained with fluid reservoir 724 and fluid ejector head 706.

Figure 7B:
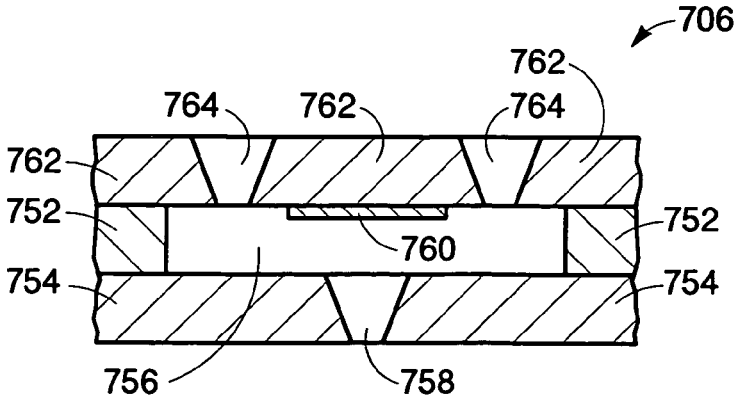
FIG. 7*b* is an expanded cross-sectional view of the fluid ejector head shown in FIG. 7*a*.

A cross-sectional view of fluid ejector head 706 of fluid ejection cartridge 716 is shown in FIG. 7*b*. Fluid ejector head 706 includes substrate 762 that has fluid ejector actuator 760 formed thereon. Fluid ejector actuator 760, in this embodiment, is a thermal resistor; however, other fluid ejector actuators may also be utilized such as piezoelectric, flex-tensional, acoustic, and electrostatic. Chamber layer 752 forms fluidic chamber 756 around fluid ejector actuator 760, so that when fluid ejector actuator 760 is activated, fluid is ejected out of nozzle 758, which is generally located over fluid ejector actuator 760. Fluid channels 764 formed in substrate 762 provide a fluidic path for fluid in reservoir 776 to fill fluidic chamber 756. Nozzle layer 754 is formed over chamber layer 752 and includes nozzle 758 through which fluid is ejected.

Figure 8:
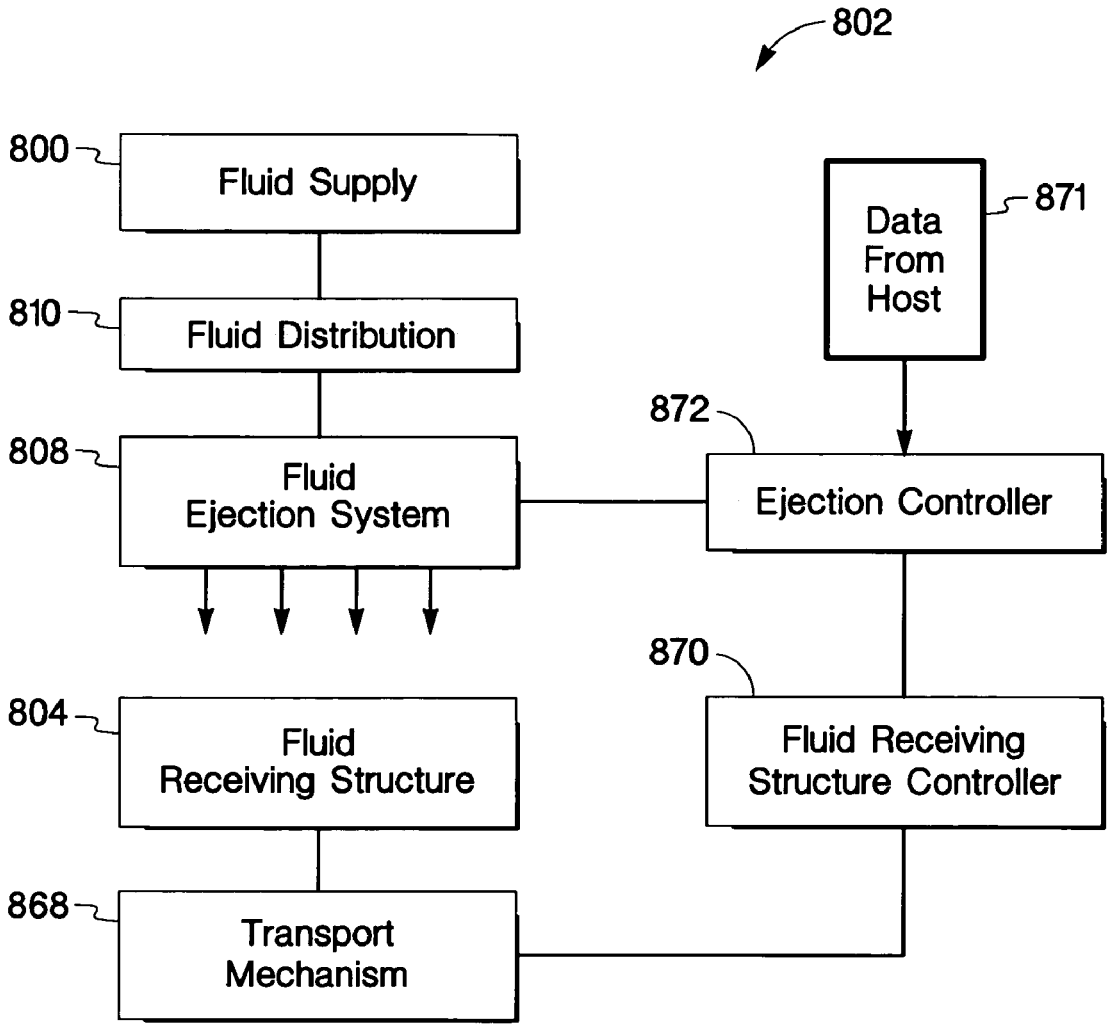
FIG. 8 is a schematic representation of a fluid dispensing system according to an embodiment of the present invention.

A fluid dispensing system employing the present invention is schematically illustrate in FIG. 8. In this embodiment, fluid dispensing system 802 is configured to dispense a fluid on or within fluid receiving structure 804. In one embodiment, the fluid comprises a liquid material such as an ink that creates an image upon a printing medium such as a sheet or roll of a cellulose based or polymeric based material. In other embodiments, the fluid may include non-imaging materials, wherein fluid dispensing system 804 is utilized to precisely and accurately dispense, distribute, proportion, and locate materials on or in fluid receiving structure 804. Fluid receiving structure may include various structures such as flexible sheets, rolls of film, vials, plates, solid supports, or any other material onto which a fluid may be dispensed. Fluid dispensing system 802 generally includes fluid supply 800, fluid distribution structure 810, fluid ejection system 808, transport mechanism 868, fluid ejection controller 872 and fluid receiving structure controller 870.

Fluid ejection system 808 generally comprises a mechanism configured to eject fluid onto fluid receiving structure 804. In one embodiment, fluid ejection system 808 includes one or more fluid ejection cartridges wherein each cartridge has a plurality of fluid ejector actuators and nozzles configured to dispense fluid in the form of drops in a plurality of locations onto fluid receiving structure 804. In alternate embodiments, fluid ejection system 808 may include other devices configured to selectively eject fluid onto fluid receiving structure 804. For example, fluid receiving structure 804 may include a tray having multiple vials or containers disposed thereon. In such an embodiment, fluid ejection system 808 may include a single fluid ejector or tightly grouped set of fluid ejectors so that each fluid ejector or grouped set of ejectors dispenses a fluid into an opening in a desired container. Fluid ejection system 808 may utilize any of the embodiments described above of reversibly fluid absorbing material.

Fluid supply 800 supplies the fluid to fluid ejection system 808 via fluid distribution device 810. In one particular embodiment, fluid distribution device 810 comprises a manifold having internal channels to route the fluid from fluid supply 800 to the appropriate fluid ejectors disposed within fluid ejection system 808. In still other embodiments, fluid distribution device 810 may include one or more conduits such as tubes to route the fluid to the fluid ejection system. Fluid supply 800 includes a reversibly fluid absorbing material similar to any of the embodiments described above. Fluid ejection system 808 also may include a reversibly fluid absorbing material similar to any of the embodiments described above.

Transport mechanism 868 comprises a device configured to move fluid receiving structure 804 relative to fluid ejection system 808. Transport mechanism 868 includes one or more structures configured to support and position either fluid receiving structure 804 or to support and position fluid ejection system 808 or both. In one embodiment, a support (not shown) is configured to stationarilly support fluid ejection system 808 as transport mechanism 868 moves fluid receiving structure 804. In printing applications, such a configuration is commonly referred to as a page-wide-array printer where fluid ejection system 808 may substantially span a dimension of fluid receiving structure 804. In an alternate embodiment, a support is configured to reciprocally move fluid ejection system 808 back and forth across a dimension of fluid receiving structure 804 while another support is configured to move fluid receiving structure 804 in a different direction. In still other embodiments, transport mechanism 868 may be omitted wherein fluid ejection system 808 and fluid receiving structure 804 are configured to dispense fluid in desired locations onto or into fluid, receiving structure 804 without lateral movement during the dispensing operation.

Ejection controller 872 generally comprises a processor configured generate control signals which direct the operation of fluid ejection system 808 and sends signals to fluid receiving structure controller 870. The term processor, in this embodiment, may include any conventionally known or future developed processor that executes sequences of instructions contained in memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage device. In other embodiments, hard wired circuitry may be used in place of or in combination with software instructions to implement the functions described. Ejection controller 872 is not limited to any specific combination of hardware circuitry and software, nor to any particular source for the instructions executed by the processing unit.

Ejection controller 872 receives data signals from one or more sources (as illustrated by data from host 871) representing the manner in which fluid is to be dispensed. Ejection controller 872 generates the control signals that direct the timing at which drops are ejected from fluid ejection system 872 as well as movement of the fluid ejection system in those embodiments in which the fluid ejection system moves relative to fluid receiving structure 804. The source of such data may comprise a host system such as a computer or a portable memory reading device associated with fluid dispensing system 802. Such data signals may be transmitted to ejection controller 872 along infrared, optical, electric or by other communication modes. In addition, in this embodiment, based upon such data signals, ejection controller 872 also sends signals to fluid receiving structure controller that direct the movement of transport mechanism 868. However, in alternate embodiments, data signals may be sent directly to fluid receiving structure controller to direct movement of transport mechanism 868.

What is claimed is:

1. A fluid supply, comprising:

a body;

a reversibly fluid absorbing material disposed in said body, said fluid absorbing material having a first surface energy; and at least one fiber disposed within said reversibly fluid absorbing material, said at least one fiber having a fiber surface energy, wherein said fiber surface energy is less than said first surface energy.

2. The fluid supply in accordance with claim 1, wherein said body is adapted to receive a fluid having a fluid surface energy, and wherein said fluid surface energy is at least 10 millijoules per meter squared less than said first surface energy.

3. The fluid supply in accordance with claim 2, wherein said fluid surface energy is at least 20 millijoules per meter squared less than said first surface energy.

4. The fluid supply in accordance with claim 1, wherein said body is adapted to receive a fluid having a fluid surface energy, and wherein said fluid surface energy is at least 10 millijoules per meter squared greater than said fiber surface energy.

5. The fluid supply in accordance with claim 4, wherein said fluid surface energy is at least 20 millijoules per meter squared greater than said fiber surface energy.

6. The fluid supply in accordance with claim 1, wherein said body is adapted to receive a fluid having a fluid surface energy, and wherein said fluid surface energy is at least 15 millijoules per meter squared less than said first surface energy and at least 10 millijoules per meter squared greater than said fiber surface energy.

7. The fluid supply in accordance with claim 1, wherein said reversibly fluid absorbing material further comprises bonded polyester fibers.

8. The fluid supply in accordance with claim 7, wherein said bonded polyester fibers further comprise bonded polyester fibers having a polyolefin core.

9. The fluid supply in accordance with claim 1, wherein said reversibly fluid absorbing material further comprises bonded polymer fibers having a polymer core and a polymeric outer sheath, wherein said polymeric outer sheath is formed from a different material than said polymer core.

10. The fluid supply in accordance with claim 1, wherein said reversibly fluid absorbing material further comprises bonded polyolefin fibers.

11. The fluid supply in accordance with claim 10, wherein said bonded polyolefin fibers further comprise bonded polypropylene fibers.

12. The fluid supply in accordance with claim 1, wherein said reversibly fluid absorbing material further comprises bonded polymer fibers.

13. The fluid supply in accordance with claim 12, wherein said bonded polymer fibers further comprise bonded polymer fibers formed from a polymer blend.

14. The fluid supply in accordance with claim 12, wherein said bonded polymer fibers further comprise, surface modified bonded polymer fibers.

15. The fluid supply in accordance with claim 12, wherein said bonded polymer fibers further comprise bonded polymer fibers having a substantial capillary direction.

16. The fluid supply in accordance with claim 15, further comprising a fluidic interconnect.

17. The fluid supply in accordance with claim 16, wherein said substantial capillary direction is substantially perpendicular to said fluidic interconnect.

18. The fluid supply in accordance with claim 16, wherein said substantial capillary direction is substantially parallel with said fluidic interconnect.

19. The fluid supply in accordance with claim 18, further comprising a pen tip in substantially permanent fluid communication with said reversibly fluid absorbing material.

20. The fluid supply in accordance with claim 1, wherein said at least one fiber further comprises at least one threading fiber.

21. The fluid supply in accordance with claim 20, wherein said reversibly fluid absorbing material further comprises a first surface and a second surface wherein said at least one threading fiber extends through said fluid absorbing material from said first surface to said second surface.

22. The fluid supply in accordance with claim 21, wherein said at least one threading fiber forms a serpentine structure extending from said first surface to said second surface.

23. The fluid supply in accordance with claim 21, wherein said reversibly fluid absorbing material further comprises a third surface and a fourth surface wherein said at least one threading fiber extends through said fluid absorbing material from said third surface to said fourth surface.

24. The fluid supply in accordance with claim 21, wherein said first and second surfaces are substantially parallel to each other, wherein said third and fourth surfaces are substantially parallel to each other and mutually orthogonal to said first and said second surfaces.

25. The fluid supply in accordance with claim 21, wherein said reversibly fluid absorbing material further comprises a third surface and a fourth surface wherein a second threading fiber extends through said fluid absorbing material from said third surface to said fourth surface.

26. The fluid supply in accordance with claim 20, wherein said at least one threading fiber further comprises at least one fluoropolymer threading fiber.

27. The fluid supply in accordance with claim 26, wherein said at least one fluoropolymer threading fiber includes a material selected from the group consisting of polytetrafluoroethylene, as fluorinated ethylene propylene copolymers, perfluoroalkoxy polymers, ethylene and tetrafluoroethylene copolymers, polyvinyl fluoride, and mixtures thereof.

28. The fluid supply in accordance with claim 20, wherein said at least one threading fiber includes a material selected from the group consisting of polyethylene, polypropylene, silicones, natural rubber, and mixtures thereof.

29. The fluid supply in accordance with claim 20, wherein said at least one threading fiber further comprises a fluoropolymer coating on said at least one threading fiber.

30. The fluid supply in accordance with claim 20, wherein said at least one threading fiber further comprises at least one threading fiber having a diameter in the range from about 5 micrometers to about 1.0 millimeter.

31. The fluid supply in accordance with claim 1, wherein said at least one fiber further comprises a plurality of short length fibers randomly dispersed within said reversibly fluid absorbing material.

32. The fluid supply in accordance with claim 31, wherein said body has an internal volume defined by three dimensions wherein one of said three dimensions is a smallest dimension, wherein said short length fibers have a length less than said smallest dimension.

33. The fluid supply in accordance with claim 31, wherein said plurality of short length fibers further comprises a plurality of short length fibers having a fiber diameter in the range from about 2 micrometers to about 50 micrometers.

34. The fluid supply in accordance with claim 1, wherein said body has an internal volume defined by three dimensions wherein one of said three dimensions is a smallest dimension less than the other two dimensions, and wherein said at least one fiber further comprises at least one long fiber having a length greater than said smallest dimension.

35. The fluid supply in accordance with claim 34, wherein said at least one long fiber further comprises said at least one long fiber having a dimension in the range from about 5 micrometers to about 1.0 millimeter.

36. The fluid supply in accordance with claim 1, further comprising a fluid ejector head attached to and in fluid communication with said body.

37. The fluid supply in accordance with claim 36, wherein said fluid ejector head further comprises a fluid ejector actuator.

38. The fluid supply in accordance with claim 37, wherein said fluid ejector actuator further comprises a thermal resistor.

39. The fluid supply in accordance with claim 36, wherein said body and said fluid ejector form a fluid ejector cartridge.

40. The fluid supply in accordance with claim 39, wherein said fluid ejector cartridge further comprises a crown having a fill port.

41. The fluid supply in accordance with claim 1, wherein said reversibly fluid absorbing material is at least partially enclosed by a fluid impervious film.

42. The fluid supply in accordance with claim 1, wherein said reversibly fluid absorbing material is formed from a mixture of fibers having a range of diameters from about 5 micrometers to about 50 micrometers.

43. A fluid dispensing system comprising:

at least one fluid supply of claim 1;

at least one fluid ejector head in fluid communication with said at least one fluid supply;

a fluid controller electrically coupled to said at least one fluid ejector head; and a fluid receiving structure controller electrically coupled to a fluid receiving structure and said fluid controller wherein said fluid controller and said fluid receiving structure controller dispense fluid from said at least one fluid supply onto or into said fluid receiving structure.

44. The fluid dispensing system in accordance with claim 43, further comprising a manifold having at least one fluid distribution channel, wherein said at least one fluid distribution channel is in fluid communication with said at least one fluid supply and with said at least one fluid ejector.

45. The fluid dispensing system in accordance with claim 44, wherein said manifold further comprises at least one tower fluidically coupled to said at least one fluid distribution channel, said at least one tower configured to engage a fluid interconnect port disposed on said body of said at least one fluid supply.

46. The fluid dispensing system in accordance with claim 44, wherein said tower further comprises a mesh filter disposed on an apex of said tower, wherein said mesh filter is configured to physically contact said reversibly fluid absorbing material.

47. The fluid dispensing system in accordance with claim 43, further comprising a transport mechanism coupled to said fluid receiving structure, wherein said fluid receiving structure and said at least one fluid ejector head move relative to the other.

48. The fluid dispensing system in accordance with claim 43, wherein said fluid receiving structure is a cellulose based or polymeric based material.

49. A method for supplying fluid, comprising:

adding fluid to a fluid reservoir, said reservoir having:

a capillary material disposed in said reservoir, said capillary material having a first surface energy, and at least one fiber disposed within said capillary material, said at least one fiber having a fiber surface energy, wherein said fiber surface energy is less than said first surface energy.

50. A replaceable container for a consumable liquid, comprising:

a fluid reservoir having a substantially rigid outer container having an interior volume;

a fluid absorbing material substantially filling said interior volume, said fluid absorbing material having a first surface energy; and one or more fibers having a second surface energy and disposed within said fluid absorbing material, wherein said first surface energy is greater than said second surface energy.

51. A fluid supply, comprising:

means for holding a fluid;

means for reversibly absorbing said fluid disposed in said means for holding said fluid, said means for reversibly absorbing said fluid having:

a capillary material having a first surface energy, and at least one fiber having a fiber surface energy, wherein said fiber surface energy is less than said first surface energy.

* * * * *